US008001647B2

(12) United States Patent
Felton

(10) Patent No.: US 8,001,647 B2
(45) Date of Patent: Aug. 23, 2011

(54) FLOCKED FOAM APPLICATOR

(76) Inventor: James J. Felton, Carmichael, CA (US)

( * ) Notice: Subject to any disclaimer, the term of this patent is extended or adjusted under 35 U.S.C. 154(b) by 794 days.

(21) Appl. No.: 12/025,031

(22) Filed: Feb. 3, 2008

(65) Prior Publication Data

US 2008/0201887 A1 Aug. 28, 2008

Related U.S. Application Data

(60) Provisional application No. 60/900,149, filed on Feb. 7, 2007.

(51) Int. Cl.
*A47L 13/10* (2006.01)
*B05C 17/10* (2006.01)

(52) U.S. Cl. ..... 15/244.1; 15/210.1

(58) Field of Classification Search ..... 15/244.1, 15/244.2, 244.3, 244.4, 210.1
See application file for complete search history.

(56) References Cited

U.S. PATENT DOCUMENTS

| | | | | |
|---|---|---|---|---|
| 4,793,019 | A * | 12/1988 | Stima et al. | 15/104.94 |
| 5,678,277 | A * | 10/1997 | Sorenson | 15/210.1 |
| 6,655,746 | B1 * | 12/2003 | Weihrauch | 300/21 |
| 7,111,353 | B2 * | 9/2006 | Cowdery | 15/209.1 |
| 2004/0177863 | A1 * | 9/2004 | McKay | 134/6 |
| 2006/0162735 | A1 * | 7/2006 | Thiebaut | 132/200 |

* cited by examiner

*Primary Examiner* — Randall Chin
(74) *Attorney, Agent, or Firm* — Ronald R. Shea, Esq.

(57) ABSTRACT

An improved flocked foam applicator has a cylindrically shaped hollow rigid shell configured to slide onto a rigid core coupled to a handle. A rigid planar surface extends from the bottom of the hollow rigid shell forward. Applicator flock extends downward from the rear cylindrical portion of the hollow rigid shell, around the bottom of the hollow rigid shell, and outward to the distal edge of the rigid planar surface. The distal edge of rigid planar surface extends further forward than the leading edge of the cylindrical hollow rigid shell. As a result of this design, the improved flocked foam applicator can apply a liquid applicant to a floor all the way up to a baseboard or wall, and will further prevent the leading edge of the cylindrical portion from coming into contact with a baseboard or wall and depositing fluid in an undesired location.

13 Claims, 3 Drawing Sheets

FLOCKED FOAM APPLICATOR

RELATED APPLICATIONS

This application claims priority from, and incorporates by reference in its entirety, U.S. Provisional Application 60/900,149 to Felton, which was filed on Feb. 7, 2007 and entitled "Flocked Foam Applicator."

FIELD OF THE INVENTION

The present invention is directed to methods and apparatus for applying liquid finishes to horizontal surfaces.

BACKGROUND

Today, there are several methods for a applying liquid finishes, such as paint, polyurethane, and other formulations, to planar rigid surfaces such as floors and walls. These methods have included brushing, rolling, spraying, and various applicators such as brushes, lambswool, synthetic and natural fiber brushes, spray heads, and flocked foam applicators. A common way to apply a liquid finish with a flocked foam applicator is to pour a liquid finish on floor, and spread the liquid finish with the flocked foam applicator. Prior art embodiments of a flocked foam applicator is formed in a tubular or cylindrical shape. In application, the tubular or cylindrical lambswool spreader covering at least part of a cylindrical core acts as both a squeegee for advancing a fluid head of the liquid finish, and an applicator, for applying the liquid finish to the floor.

DETAILED DESCRIPTION

Figure 1:
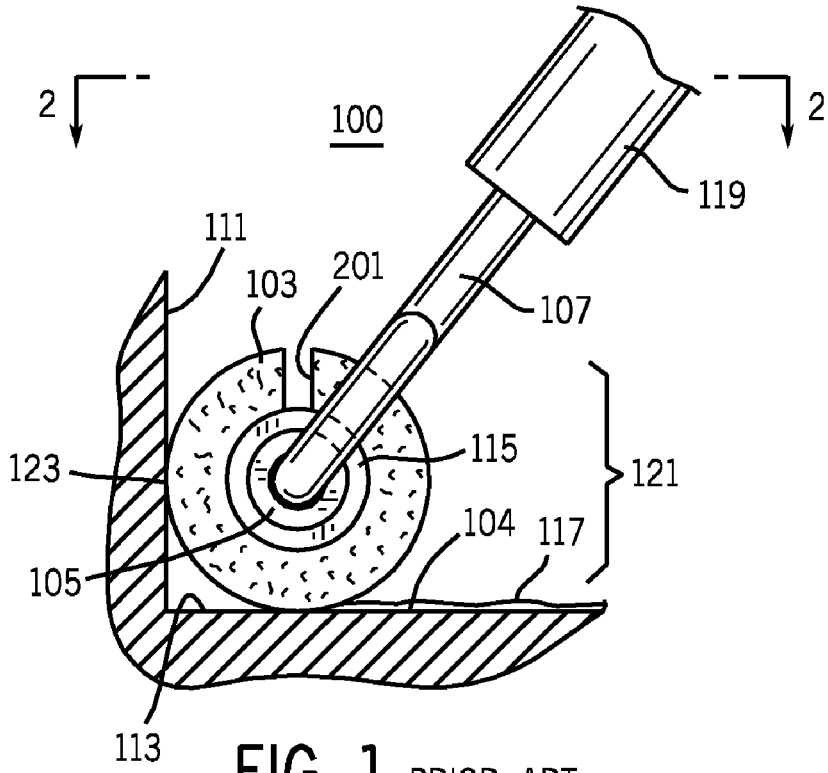
FIG. 1 PRIOR ART
FIG. 1 is a side elevation view of a prior art flocked foam applicator assembly.

FIG. 1 is a side elevation view of a prior art flocked foam applicator assembly 100. The flocked foam applicator assembly includes a flocked foam applicator 121 comprising a hollow rigid shell 115 to which an absorbent applicator surface 103 is affixed. The hollow rigid shell is preferably curved about an axis, and more preferably, cylindrically shaped about a cylindrical axis. However, other shapes are envisioned for the hollow rigid shell. The absorbent applicator 103 is typically comprised of a textile-like materials such as lambswool or synthetic flock. A rigid core 105 can be slid into the inner cavity of the hollow rigid shell. The rigid core is fixedly coupled to rigid extension 107 which extends between the rigid cylindrical core 105 and a rigid handle 119. Within FIG. 1, the absorbent applicator 103 of the flocked foam applicator 121 is pictured at the juncture of a floor 104 and a wall 111. A liquid applicant 117 such as paint or polyurethane is depicted on the floor adjacent the absorbent applicator. A gap 113 is visible in front of the flocked foam applicator. Prior art flocked foam applicators are not capable of properly applying a liquid applicant to this region.

Figure 2:
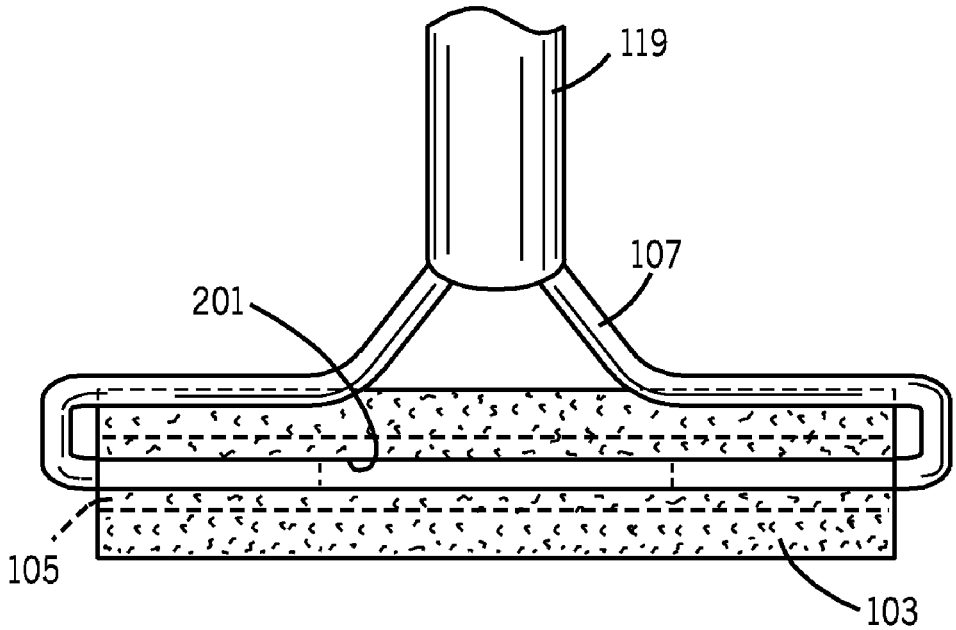
FIG. 2 PRIOR ART
FIG. 2 depicts a top plan view of the flocked foam applicator assembly 100 of FIG. 1.

FIG. 2 depicts a top plan view of the flocked foam applicator assembly 100 of FIG. 1. A longitudinal gap 201 extends the entire length of the cylindrical portion of hollow rigid shell 115, oriented parallel to the axis of the cylinder. The rigid extension 107 extends through the longitudinal gap, thereby coupling the handle 119 to the rigid cylindrical core 105. The rigid extension 107, and the rigid cylindrical core 105 affixed thereto, can be slid parallel to the axis of the flocked foam applicator assembly, so as to insert the rigid cylindrical core 105 into the cavity of the hollow rigid shell 115, or alternatively, to withdraw the rigid cylindrical core 105 from the hollow rigid shell 115. By this design, the hollow rigid shell 115, and the absorbent applicator 103 affixed thereto may be disposed of, without disposing of the handle 119, the rigid extension 107 or the rigid cylindrical core 105. Following disposal of a used applicator, a new flocked foam applicator comprising a hollow rigid shell 115 with an absorbent applicator 103 affixed thereto, may be slid over the rigid selectable core 105, thereby providing a fresh flocked foam applicator 121 for applying a liquid applicant 117 to the floor 104.

Referring again to FIG. 1, because of the cylindrical shape of the flocked foam applicator 121, the most horizontally advanced portion 123 of the flocked foam applicator 121 typically engages the wall 111, baseboard, or other vertical member during operation. There are two problematic aspects of this event, owing to the existing design of the flocked foam applicator. The first problem is that the absorbent applicator 103 does not touch the floor 104 within the corner section 113. As a consequence, the flocked foam applicator cannot properly apply the liquid applicant 117 to the floor 104 in the corner section 113. Additionally, because the liquid applicant typically saturates large portions of absorbent applicator 103, when the most horizontally advanced portion 123 of the flocked foam applicator 121 touches wall, 111, baseboard, or other vertical surface, it can inadvertently deposit the liquid applicant 117 on a wall baseboard.

Figure 3:
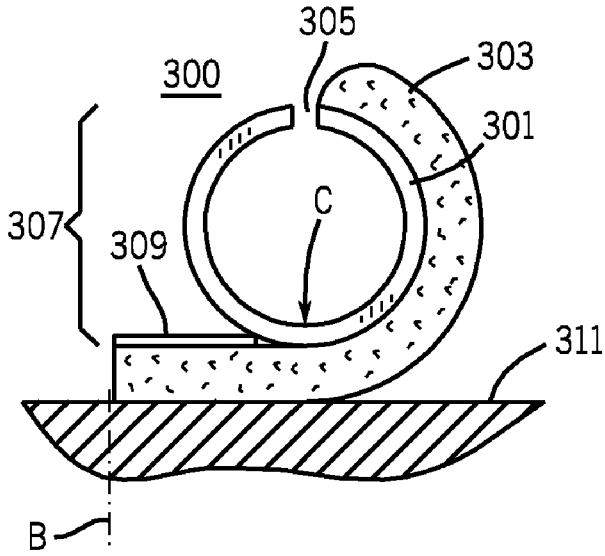
FIG. 3 depicts is a side elevation view a flocked foam applicator 300 according to an embodiment of the present invention.
Figure 4:
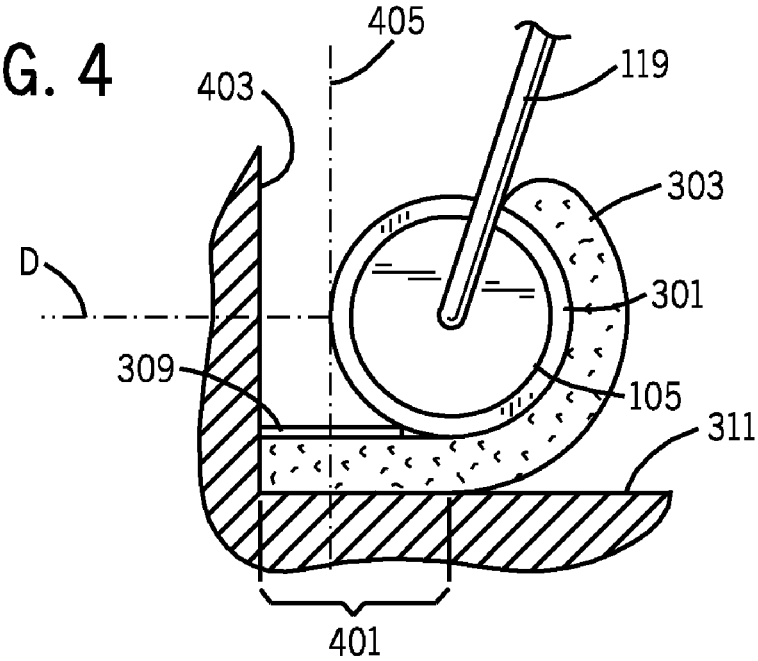
FIG. 4 depicts a side elevation view of the flocked foam applicator with a resistance member for holding the planar application section against the floor.

FIGS. 3 and 4 depict side elevational views of a flocked foam applicator 300 according to an embodiment of the present invention. The flocked foam applicator 300 includes an absorbent applicator 303 having an absorbent exterior surface, and an interior surface coupled to a hollow rigid shell 301. A longitudinal gap 305 is formed in the hollow rigid shell 301 and absorbent applicator 303. According to one embodiment, the longitudinal gap extends the length of the hollow rigid shell 301, from end to end. In alternative embodiments, the longitudinal gap can extend from one end of the shell 301 to approximately the center of the shell, thereby limiting insertion of the rigid extension 107 from only one end of the shell. As illustrated in FIG. 3, the absorbent applicator extends from adjacent the longitudinal gap at the top of the hollow rigid shell 301, down the right-hand side of the hollow rigid shell, to the bottom of the hollow rigid shell. The point at which the hollow rigid shell is tangent to the floor is depicted as point C. At approximately the tangent point C, the orientation of the absorbent applicator 303 ceases to conform to the exterior curvature of the hollow rigid shell 301. The absorbent applicator 303 to the left of the tangent point D forms a planar application section 401 that, in use, is configured to remain in a substantially horizontal orientation. To maintain a fixed orientation, the interior surface (or "upper surface" in FIGS. 4 and 5) of the planar application section 401 of the absorbent applicator 303 is coupled to a rigid member 309.

Referring to both FIG. 3 and FIG. 4, the rigid member 309 functions to ensure that the planar application section 401 of exorbitant applicator 303 remains in contact with the floor 311.

In an embodiment depicted in FIG. 4, the leading edge of the hollow rigid shell 301 is depicted as point "D" and by the dotted perpendicular line 405. The planar application section 401 extends beyond the leading edge 405 of the hollow rigid shell 301. The first advantage of this design is that the absorbent applicator does not deposit the liquid applicant on the wall parallel to the leading edge 405 of the hollow rigid shell, because there is no absorbent applicator along the leading edge 405 of the hollow rigid shell 301, and because the distal edge of the planar application section 401 extends further forward than the leading edge 405 of the cylindrical hollow rigid shell. This design further ensures that the absorbent applicator 303 will not lose contact with the floor 311 in the last few centimeters of where the floor abuts a wall or baseboard.

In the embodiment shown in FIG. 4, the orientation of the planar application area 401 is maintained by a rigid member 309 such as a flat rigid piece of material. According to an embodiment, the thickness of rigid member 309 ranges from about 2 mm to about 15 mm, though embodiments of greater or lesser thickness are envisioned.

Figure 5:
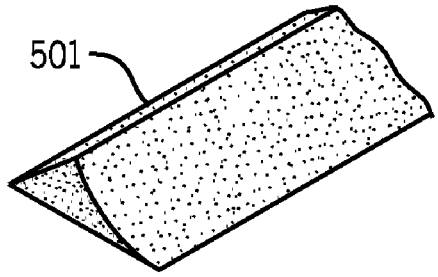
FIG. 5 depicts a side elevation view of a wedge shaped member that can function as the resistance member of FIG. 4
Figure 6:
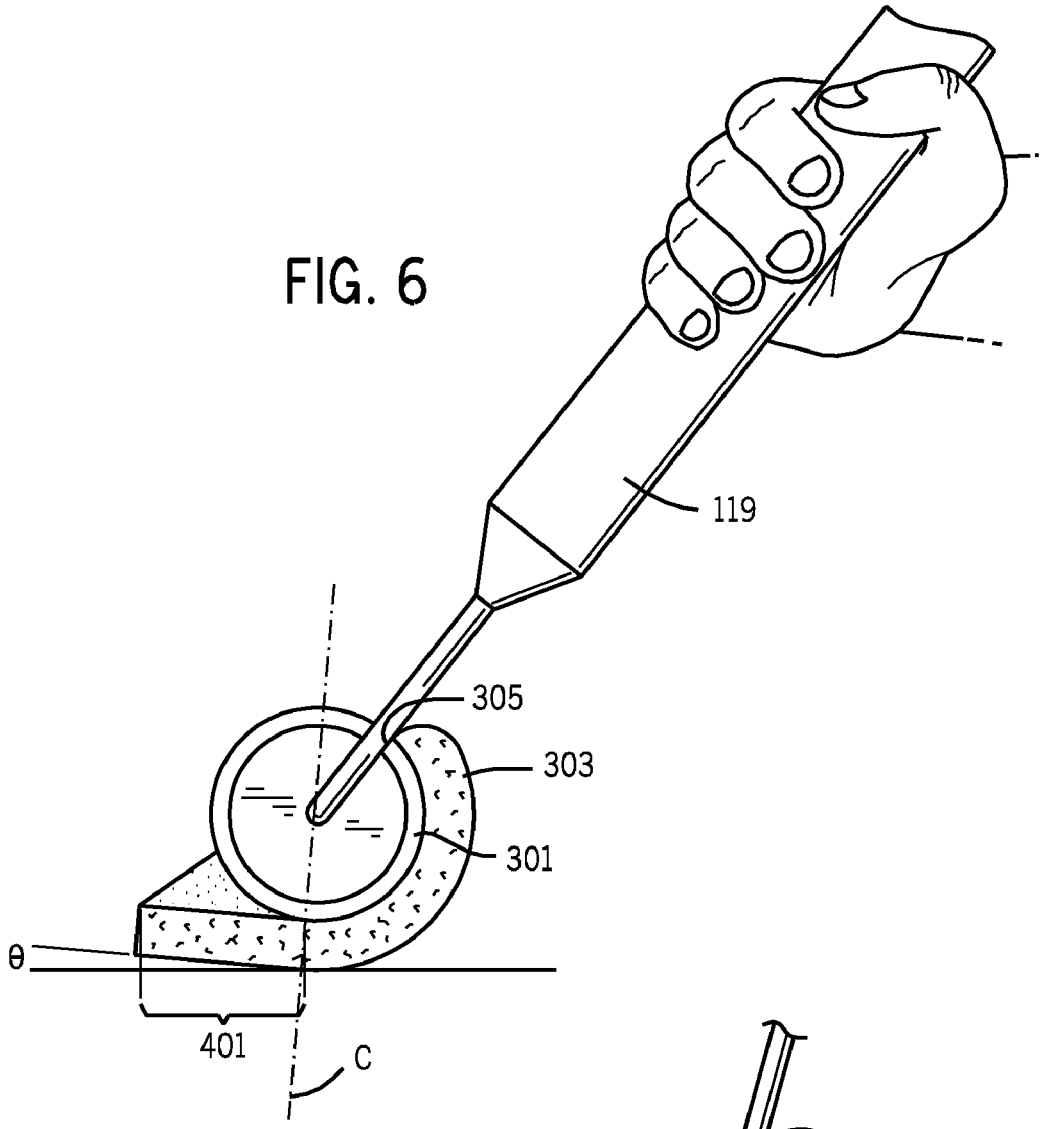
FIG. 6 depicts a side elevation view of the flocked foam applicator attached to a handle.
Figure 7:
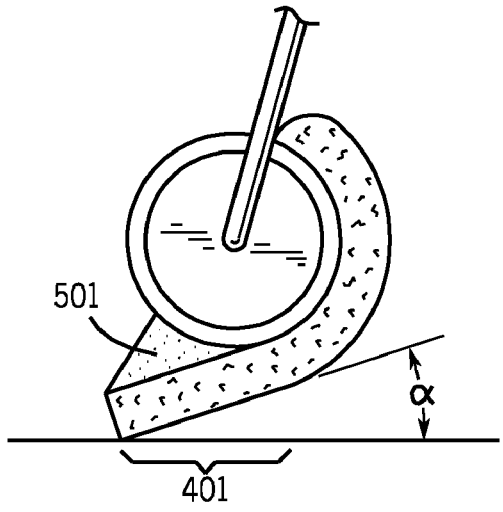
FIG. 7 depicts the flocked foam applicator of FIG. 6 prior to an application of force by a user, and subtending an angle $\alpha$ from a floor surface.

In an alternative embodiment, as shown in FIG. 5, a wedge shaped member 501 functions to maintain a constant horizontal orientation of the planar application section 401, as depicted further in FIGS. 6 and 7. The wedge shaped member 501 can be held in place by securing the lower surface of the wedge shaped member to the upper surface of the absorbent applicator 303, by securing the right hand surface of the wedge shaped member to the hollow rigid shell 301, or by securing both of these surfaces. As noted in FIG. 5, the right hand edge of the wedge shaped member 501 is curved to match the curvature of the outer surface of the hollow rigid shell. In a preferred embodiment, the wedge shaped member 501 is formed from an elastomer or sponge material so that it can deform under pressure, and regain its original shape after the pressure is released.

FIG. 6 depicts an embodiment of the flocked foam applicator of FIGS. 3 and 4 during use. The longitudinal gap 305 within the rigid cylindrical core 301 is positioned such that when the handle 119 is positioned at the normal angle of use, the planar application section 401 of the absorbent applicator 303 is oriented in a substantially horizontal orientation. However, in the embodiment of FIG. 6, if a user is standing in a fixed position and pushes the handle forward, extending his arm away from his body) such that the application head slides across the floor, the user will typically lower his hand as he slides the applicator forward. As a result, the handle will typically rotate clockwise (reducing the angle between the handle and the floor from the perspective of the drawing). As a consequence, the planar application section 401 may rise off the floor by an angle $\theta$ as the user extends his arm, thereby failing to properly coat the floor with the fluid or liquid on the section of floor wherein the floor abuts a wall or molding along a bottom of a wall.

FIG. 7 shows an alternative embodiment to FIG. 6, wherein the distal edge of the planar application section 401 is oriented in a slightly downward angle $\alpha$ relative to the floor when the handle is at an angle typically held by a user. When a deformable wedge described in FIG. 5. is used in conjunction with this embodiment, a downward pressure on the handle 119 by the user will deform the wedge and bend the planar application section 401 at roughly the point beneath the leading edge 405 shown in FIG. 4, thereby causing contact between the entire planar application section 401 and the floor. Again, imagining a user standing in a fixed position, as the user extends his arm forward (away from his body) to advance the flocked foam applicator across the floor, the handle the angle between the handle and the floor is progressively reduced, asserting a clockwise rotation on the applicator.

However, instead of raising the distal edge of the planar application section 401 off of the floor, the foam wedge will expand, forcing the tip downward, maintaining contact between the tip of the planar application section 401 and the floor. By the use of a "soft" elastomer or sponge wedge that can easily be deformed by slight pressure, the natural angle $\alpha$ may be as great as 45 to 85 degrees, allowing forward thrust of the handle to a distance wherein the handle is nearly parallel to the floor. Such an embodiment would be useful in spreading a liquid applicant on a floor underneath a fixed structure, or on the section of floor wherein the floor abuts a wall or molding along a bottom of a wall, a motion typically requiring the handle to be rotated downwards. However, in most applications, an angle of between zero and 45 degrees would be preferred.

Throughout this disclosure, many specific details have been offered to enable one skilled in the art to make and use the invention described herein. These details are offered to be enabling, and are not intended to limit the scope of the appended claims, which comprehends alternative embodiments depicted within the scope of the claims.

I claim:

1. An improved flocked foam applicator for applying a liquid applicant to a floor, the improved flocked foam applicator having:

a handle;

a rigid core comprising an outer surface, at least a portion of the outer surface of the rigid core defining a cylindrical section, wherein the rigid core is coupled with the handle;

an absorbent applicator with an inner surface and an applicator surface, the absorbent applicator comprising a curved application section and a planar application section; and, a resistance member with a substantially planar surface; wherein, i) the inner surface of the curved application section is coupled with a cylindrical portion of the outer surface of the rigid core; and ii) the inner surface of the planar application section is coupled with the substantially planar surface of the resistance member, the resistance member being configured to exert a resistive force against the inner surface of the planar application section of the absorbent applicator.

2. The improved flocked foam applicator of claim 1, wherein the cylindrically shaped rigid core defines a cylindrical axis, and includes a longitudinal gap extending a length of the rigid core, the longitudinal gap aligned parallel to the cylindrical axis.

3. The improved flocked foam applicator of claim 1 wherein the cylindrically shaped rigid core is hollow, further comprises an inner surface.

4. The improved flocked foam applicator of claim 1 wherein the resistance member comprises a wedge shape that includes the substantially planar surface.

5. The improved flocked foam applicator of claim 4 wherein the wedge-shaped resistance member has a second wedge surface configured to exert a force against the rigid core.

6. The improved flocked foam applicator of claim 5 wherein the second surface of the wedge-shaped resistance member is curved to conform to a curvature of the rigid core.

7. The improved flocked foam applicator of claim 1 wherein the resistance member is deformable.

8. The improved flocked foam applicator of claim 1 wherein the resistance member is a rigid flat member coupled to the rigid core.

9. The improved flocked foam applicator of claim 1 wherein the resistance member is configured such that when the planar application section is parallel with the floor and no force is being exerted upon the resistance member, an angle between the handle and the floor will be between ten degrees and eighty degrees.

10. The improved flocked foam applicator of claim 1, wherein the planar application section is configured to remain in a horizontal orientation during use.

11. The improved flock foam applicator of claim 1, wherein the outer surface of the rigid core is releasably coupled with the inner surface of the absorbent applicator.

12. The improved flocked foam applicator of claim 1 wherein the planar application section terminates along a distal edge.

13. The improved flocked foam applicator of claim 12 wherein the distal edge is a linear edge.

* * * * *